United States Patent [19]

Schaefer

[11] Patent Number: 4,529,364

[45] Date of Patent: Jul. 16, 1985

[54] CASING GAS PUMP

[76] Inventor: Larry Schaefer, 2810 Ann St., Big Spring, Tex. 79720

[21] Appl. No.: 490,387

[22] Filed: May 2, 1983

[51] Int. Cl.[3] ..... F04B 49/00

[52] U.S. Cl. ..... 417/306; 417/309; 166/68.5; 92/244

[58] Field of Search ..... 417/306, 309, 284; 166/68.5, 72, 75 R, 84; 92/244, 249; 60/372; 74/41

[56] References Cited

U.S. PATENT DOCUMENTS

| | | | |
|---|---|---|---|
| 1,915,827 | 6/1933 | Kickler | 74/41 |
| 2,174,123 | 9/1939 | Davis | 166/75 X |
| 2,274,304 | 2/1942 | Perry | 92/244 X |
| 2,555,426 | 6/1951 | Trautman et al. | 60/372 |
| 2,560,676 | 7/1951 | White | 60/372 |
| 2,765,742 | 10/1956 | King | 417/464 |
| 4,345,734 | 8/1982 | Studinger | 248/354 C X |
| 4,369,839 | 1/1983 | Freeman et al. | 166/68.5 X |

FOREIGN PATENT DOCUMENTS

| | | | |
|---|---|---|---|
| 1070216 | 1/1980 | Canada | 60/372 |

OTHER PUBLICATIONS

Joy et al., "Flexible Sucker Rod in the Works", *The Oil and Gas Journal,* 7-15-68, pp. 138-140.

*Primary Examiner*—Carlton R. Croyle
*Assistant Examiner*—Donald E. Stout
*Attorney, Agent, or Firm*—Wendell Coffee; Montgomery W. Smith

[57] ABSTRACT

A casing gas pump is reciprocated by the pump jack of an oil well. Push rods slidable within rigid vertical cylinders are connected by a bridle bracket to bridle cables depended from the pump jack horsehead. Vertical reciprocation of the horsehead moves pump leathers connected to the push rods up and down within cylinder bores. The cylinders are vertical, non-pivoting and fluidly connected to a header. The header is connected to the annulus of the well and to a gas line. Check valves prevent back flow from the header into the annulus and from the gas line into the header. The pump leathers form reciprocating pistons that are formed and assembled to avoid pulling a vacuum on the annulus.

2 Claims, 5 Drawing Figures

CASING GAS PUMP

BACKGROUND OF THE INVENTION (1) Field of the Invention

This invention relates to producing oil wells and more particularly to reduction of annulus gas pressure in such wells.

(2) Description of the Prior Art

Producing oil wells usually have a casing extending down to the producing strata. Oil is pumped through tubing within the casing. A sucker rod pump connected to the tube is operated by a sucker rod reciprocated within the tube by a pump jack.

Before this application was filed, a search was made in the United States Patent and Trademark Office. That search developed the following United States patents: King, U.S. Pat. No. 2,765,742; Suman, Jr. U.S. Pat. No. 3,773,437.

The Suman, Jr. patent is considered pertinent because the applicant believes the Examiner would consider anything revealed by the search to be relevant and pertinent to the examination of this application.

Prior to my invention, workers in the art discovered that gas pressure within the annulus between the casing and the tubing adversly affected operation of the sucker rod pump. Annulus gas pressure has been relieved by pumping it from the annulus with a compressor powered by a motive force other than the pump jack.

King recognized that it would be advantageous to employ the reciprocation of the pump jack to operate the compressor or gas pump. King connects his gas pump to the walking beam of the pump jack. This causes numerous problems in that the cylinder, or compressor, must pivot to account for the radial swings of the walking beam. Additionally, a compressor according to the teachings of King could reduce the pressure in the annulus of the oil well to less than atmospheric pressure, which is prohibited in some states.

SUMMARY OF THE INVENTION (1) New Function and Surprising Results

I have invented a casing gas pump operated by action of the pump jack of an oil well that accomplishes the unusual and surprising results of pumping gas with a fixed, non-pivoting compressor that will not pull a vacuum on the annulus with my novel combination of pipes, rods, valves, tubing, etc.

My invention connects the push rods of pump cylinders to the bridle cables of a pump jack. The bridle cables connect the polished rod of the sucker rods to the horsehead at the end of a walking beam of the pump jack. Since the movement of these bridle cables is substantially vertical, my invention requires no pivoting cylinder mounting as does KING.

Additionally, the use of leathers as the compressor piston assembly within the compressor cylinder accomplishes the desirable results of suction and compression without the danger of pulling a vacuum on the annulus. As used herein, the phrase "pulling a vacuum on the annulus" refers to reducing the annulus pressure substantially below ambient or atmospheric pressure. I prefer to use leathers similar to those used in windmills, with the cupped or curved edges of the working leathers inclined downward. During an upstroke of the push rod and leathers, the working leathers will allow gas to escape around the downward edges thereof when the pressure within the annulus is decreased substantially below atmospheric or ambient pressure. Conversely, during a downstroke, the edges of the working leathers will be forced against the bore, preventing escape of gas past the working leathers.

It is desirable to have the compression ratio of the pump as high as possible to maintain maximum volumetric efficiency. Therefore, the volume of the headers is substantially less than the volume of the cylinder bores. It may be seen that the functioning of the leather assembly causes the annulus pressure to be maintained at or above the ambient or atmospheric pressure. Therefore, the primary force applied by the pump jack and sucker rods is the downward force to force the gas into the gas line, which may have a pressure of up to 60 psig.

(2) Objects of this Invention

An object of this invention is to reduce annulus gas pressure within the casing of oil wells.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
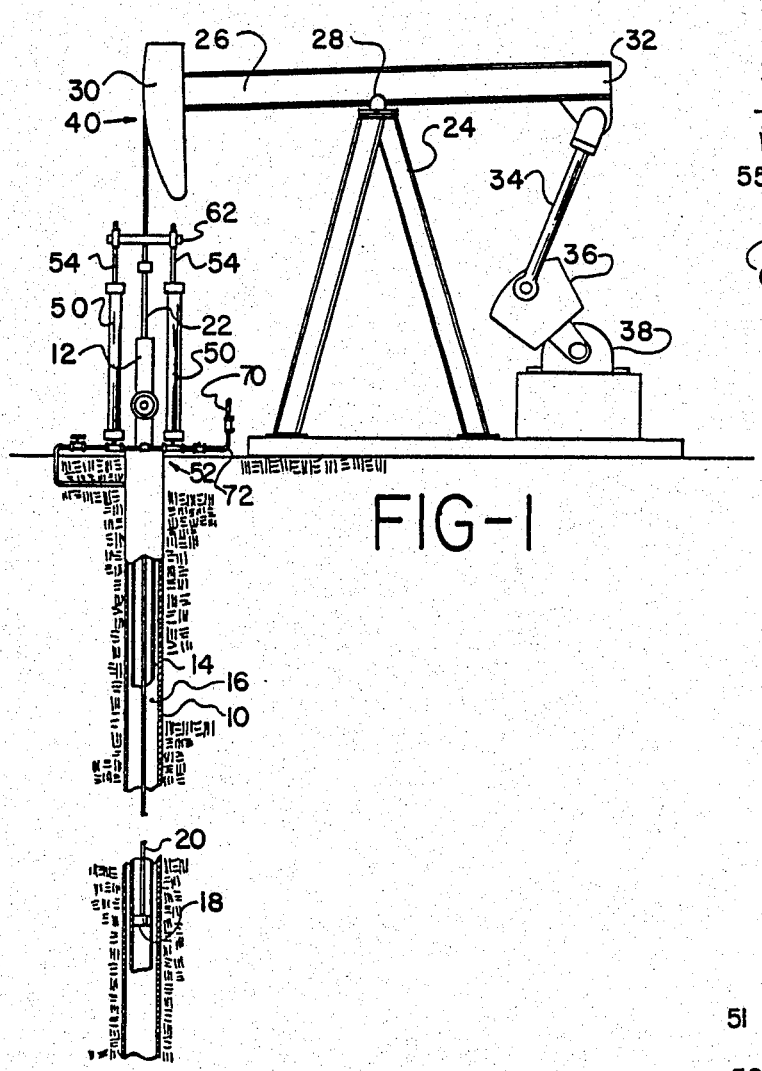
FIG. 1 is a schematic representation of an oil well with a casing gas pump according to my invention mounted thereon.
Figure 2:
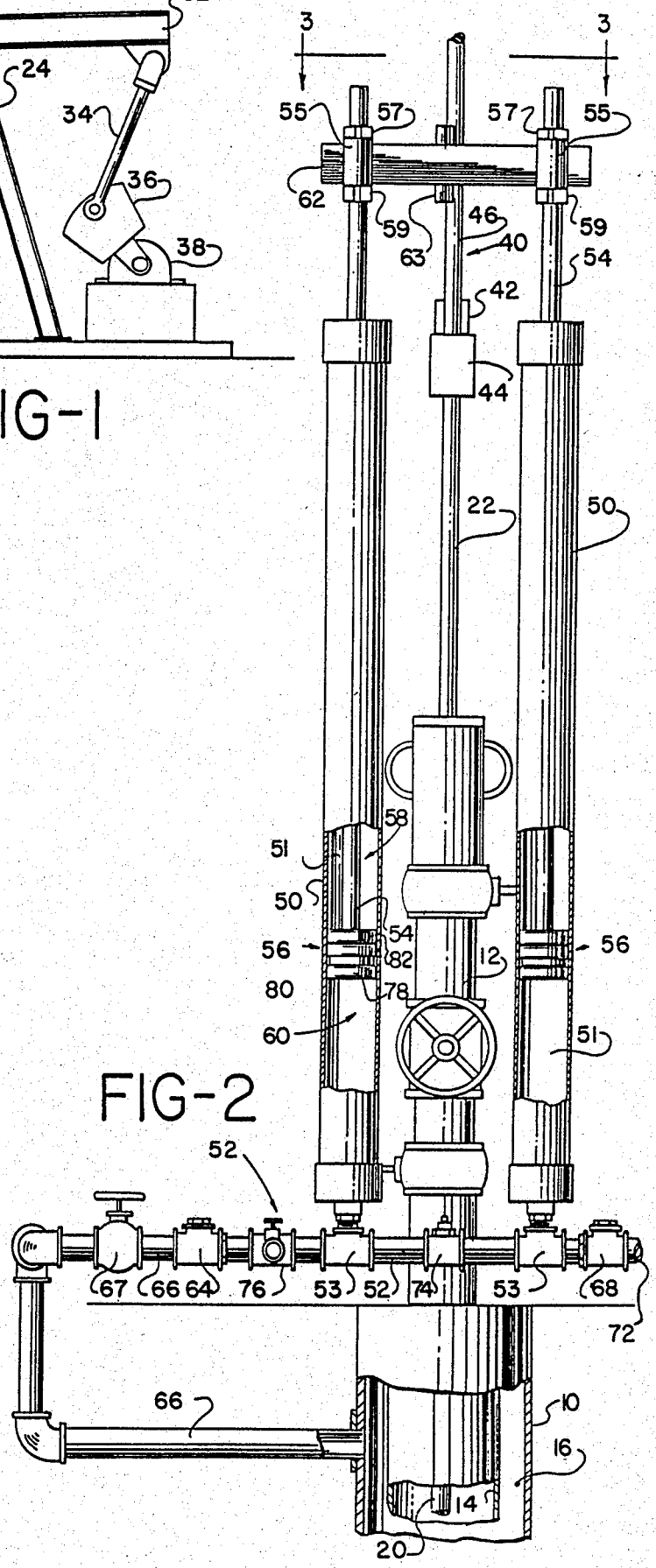
FIG. 2 is a side elevational view of a casing gas pump mounted on an oil well.
Figure 3:
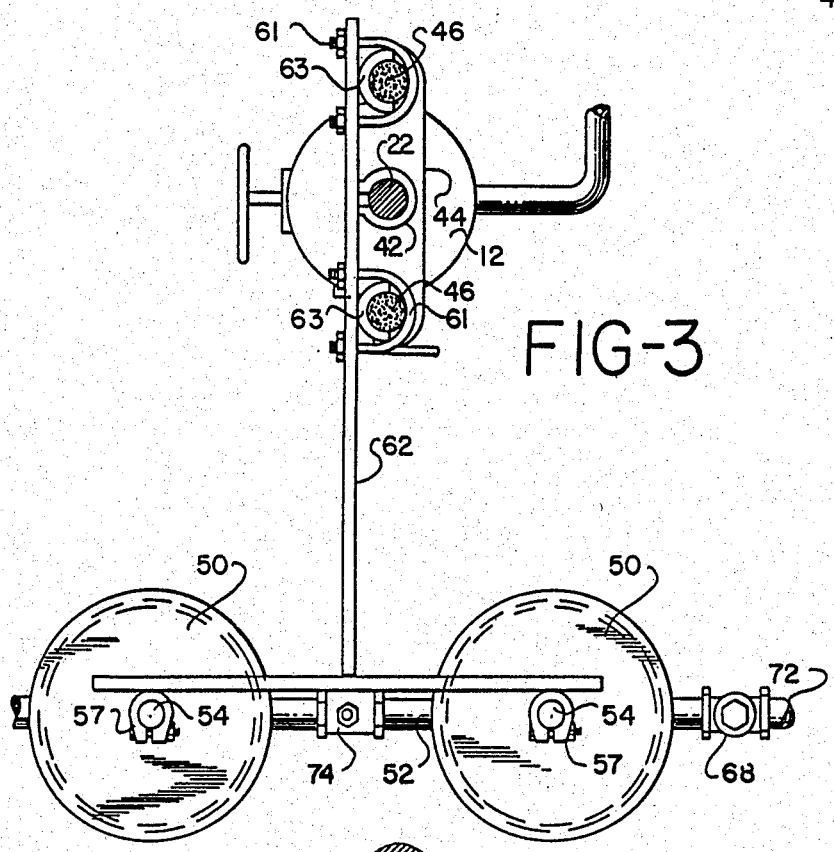
FIG. 3 is a top sectional view taken substantially along line 3—3 of FIG. 2.
Figure 4:
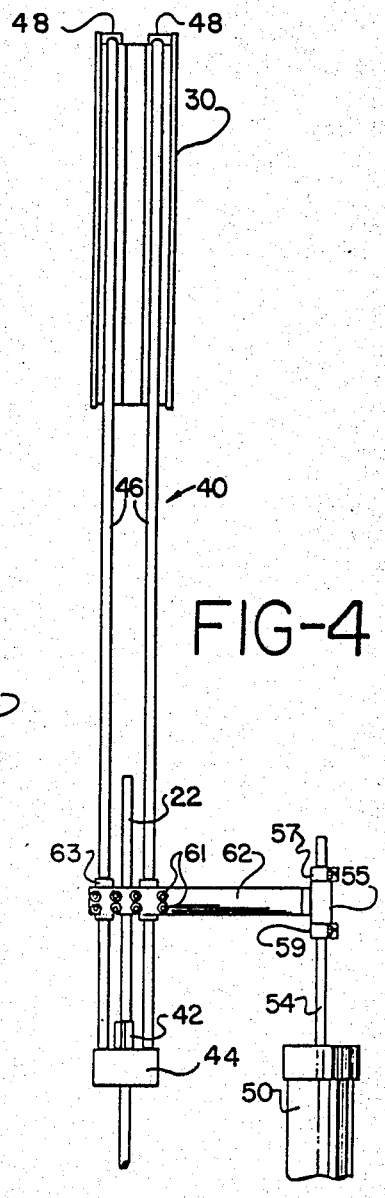
FIG. 4 is a front elevational view of the bridle bracket connection for the pump shown in FIG. 2.

FIG. 1 schematically shows a typical oil well having casing 10 extending downward below ground surface with wellhead 12 associated therewith above the ground surface. Eduction tube or tubing 14 depends from the wellhead 12 within the casing 10 forming annulus 16 between the tube and the casing. Sucker rod pump 18 is located in the producing strata of the well substantially below ground. Sucker rod 20 formed of a plurality of rods connected end to end is connected to the sucker rod pump 18 and extends upward within the tube 14 through the wellhead 12. The top section of the sucker rod extending through the wellhead is polished rod 22.

A pump jack associated with the wellhead includes sampson post 24, walking beam 26 pivoted to the sampson post at pivot 28 therealong, and horsehead 30 attached to an end of the walking beam above the wellhead. The end of the walking beam 26 opposite the horsehead 30 is pitman end 32. Pitman 34 is pivoted at one end to the pitman end. The pitman is pivoted at its other end to crank 36 journaled to gearbox 38 for revolution about a crank axis. As the crank is revolved about the crank axis, the pitman end of the walking beam will be moved up and down. The gearbox and crank are driven by a motor (not shown). Therefore, the crank, gear box and motor form reciprocation means for moving the horsehead up and down. Those familiar with the art will note that the pitman may be pivoted to the walking beam at points other than that shown in FIG. 1.

The horsehead 30 is connected to the polished rod 22 by a bridle assembly 40. The bridle assembly includes polished rod clamp 42 affixed to the polish rod, carrier bar 44 below the polished rod clamp, and bridle cables 46 connected at one end to the carrier bar 44 and at the other end to cable anchor 48 on the top of the horsehead 30.

The curved face of the horsehead exerts a vertical pull on the carrier bar. The movement of the bridle cables 46 immediately above the carrier bar and polish rod clamp is substantially vertical without sidewise or arcuate movement. Those skilled in the art will be aware of the great variety of pump jacks used in connection with oil wells, and that my invention is applicable to those pump jacks having a connection to the sucker rod that is moved substantially vertically up and down as opposed to swung through a radial arc about the walking beam pivot.

Cylinders 50 each have a top, a bottom, and cylindrical bore 51 extending from the top to the bottom. The cylindrical bores 51 are rigidly and fluidly connected to header 52 at the cylinder bottoms by header connectors 53. The cylinders are vertical, adjacent the wellhead, and preferably in a position close to the bridle assembly, yet not in a position to interfere with the operation of the pump jack or servicing of the well. The cylinders are rigidly immobilized to prevent pivoting or movement during reciprocation. Upright push rods 54 are depended through the top of the cylinders 50 into the cylindrical bores. Leather assemblies 56 are attached to the ends of the push rods within the bores. The leather assemblies form pistons that substantially segregate the volume enclosed by the cylindrical bores into upper chambers 58 and lower chambers 60. As described above, the lower chambers 60 are fluidly connected through the cylinder bottoms to the header 52. The cylindrical bores are rigidly connected to the header at the cylinder bottom through the header connectors.

The tops of the push rods 54 are connected to rigid bridle bracket 62. The bridle bracket 62 is rigidly connected to the bridle cables 46 just above the polished rod clamp 42 and the carrier bar 44. The diameters of the cables 46 and the polished rod 22 are exaggerated in the drawing. The bridle bracket is preferably clamped to the cables with U-bolts 61 extending around the hemicylindrical cable guides 63 bolted to the bridle bracket such that vertical movement of the bridle cables will also cause the bridle bracket to be vertically moved. The bridle bracket 62 is preferably horizontal to the ground and extends to positions above the cylinders and to the push rods 54. The push rods 54 are preferably connected to the bridle bracket by tubular rod guides 55 welded to the bridle bracket with the rods being slidable within the guides 55. The rods are adjustably secured to the guides and the bracket 62 by upper rod clamps 57 and lower rod clamps 59. Therefore, during operation of the pump jack, the up and down movement of the bridle cables will reciprocate the push rods and leather assemblies in an upstroke and a downstroke within the cylinder bores, responsive and equal to the reciprocation of the horsehead and bridle cables, thereby evoking a pumping action. The construction and alignment of the leather assemblies will be more fully described later.

The header 52 has an inlet end with inlet check valve 64 fluidly connected thereto. The inlet check valve 64 is fluidly connected through inlet conduit 66 to the annulus 16 between the casing 10 and the tube 14. The upstroke of the push rods will place suction on the annulus and withdraw gasses from the annulus into the header and lower chamber. The inlet check valve 64 is a one-way valve permitting flow from the annulus into the header, but preventing flow from the header back into the annulus. Shut off valve 67 is in the inlet conduit between the inlet check valve and the annulus.

The header 52 also has an outlet end opposite the inlet end with outlet check valve 68 fluidly connected thereto. The outlet check valve is in turn fluidly connected to a meter or gas line 70 by outlet conduit 72. The outlet check valve is also a one-way valve permitting flow from the header into the gas line through the outlet conduit, but preventing flow from the gas line through the outlet conduit into the header.

At the end of the upstroke of the push rod and leather assembly, the push rod and leather assembly will be forced downward by the bridle cables. The compression will force the gasses from the lower chamber and header through the outlet check valve into the gas line.

The pressure in the gas line may be as much as 60 psig. Therefore, the casing gas pump is preferably capable of high compression to force annulus gas collected on the upstroke into the gas line on the downstroke. As shown in the drawings, the volume of the header is much smaller than the volume of the cylinders. Additionally, the available volume within the cylinder bore is used for the stroke such that the stroke substantially extends through the length of the cylinders. Thus, the preferred embodiment has sufficient volumetric efficiency to pump gas into the pressurized gas line.

For safety, pressure relief valve 74 is preferably installed in the header 52. For convenience, I also prefer to provide bleed valve 76 in the header 52.

Figure 5:
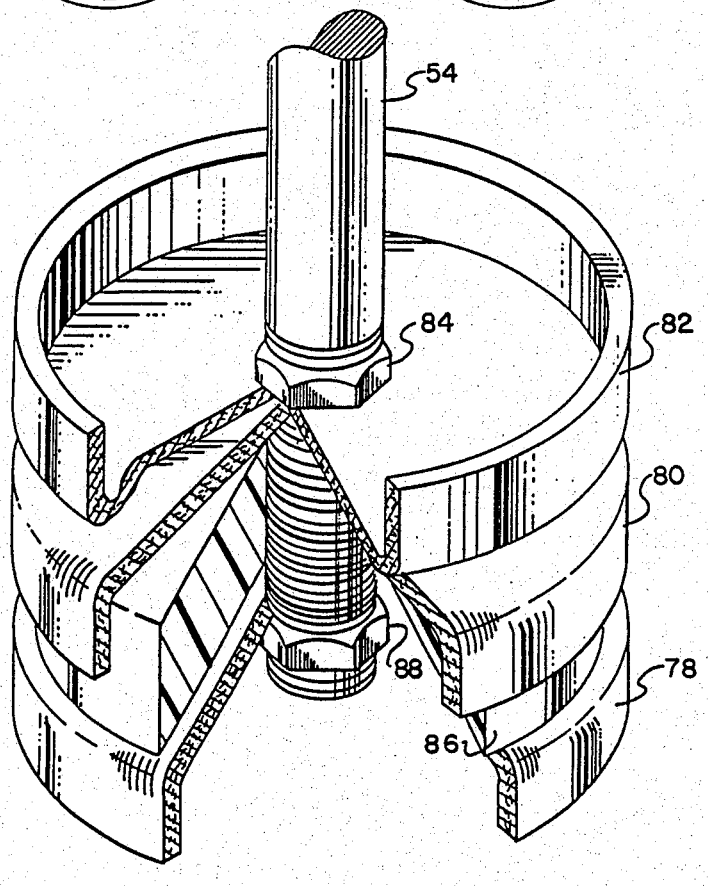
FIG. 5 is a sectional view of a leather assembly.

FIG. 5 shows a detailed sectional view of the leather assembly or piston. Pump leathers of the leather assembly include working leathers 78 and 80, and lubricating leather 82. The working leathers are similar to those used in windmills, except that the leathers preferably employed are about four inches or more in diameter. The working leathers are cupped downwardly such that the edges of the leathers are inclined downward proximate to and contacting the cylinder bore. The lubricating leather is cupped upward to contact and adequately wipe the cylinder walls during the upstroke.

I prefer to attach the leather assemblies to the ends of the push rods as follows. The push rod has threads at the bottom end thereof. A jam nut 84 is screwed onto the push rod end, and then the lubricating leather 82 is placed behind the jam nut 84 with the cup curved upward or away from the threaded rod end. The working leather 80 is then placed adjacent the lubricating leather 82 with the cup curved downward. Plastic spacer 86 is then placed behind the working leather 80 and the working leather 78 is placed behind the plastic spacer 86. The plastic spacer insures that the working leather 80 is expanded against the bore 51, and able to act independently of the working leather 78. Jam nut 88 is then placed behind the working leather 78, and the leather assembly is tightened by screwing the jam nuts down tightly against the leathers.

In operation, the resilience and rigidity of the leathers will cause them to press against the bore during the upstroke, thereby preventing escape of gasses past the leather assembly and decreasing the pressure within the lower chamber, and suctioning the gases from the annulus therein too. However, when the pressure within the annulus and the lower chamber decreases below atmospheric or ambient pressure, the leathers are not sufficiently resilient to prevent partial collapse and leakage of air about the leather assembly into the lower chamber. Thus the use of leather similar to those used in windmills avoids pulling a vacuum on the annulus.

During the downstroke, the gas within the lower chamber will exert pressure on the working leathers and the downwardly cupped edges thereof. Pressure will force the leather edges against the bore, thereby preventing escape of gasses past the leather assembly or piston. This pressure and sealing will increase as the pressure within the lower chamber and header is increased by the downstroke. When the header and lower chamber pressure exceeds that in the gas line and outlet conduit, gasses will flow into the gas line.

Although leather is the preferred material for the cylinder piston, any material with the particular flexibility and rigidity possessed by such leathers could be employed in connection with my invention. It will be understood that if it is desirable and permissible to pull a vacuum on the annulus, a piston assembly different from that shown in the drawings could be employed and still employ the bridle bracket and pump of my invention.

I prefer to construct the cylinders of PVC (polyvinyl chloride) pipe with PVC bushings at the cylinder top and bottom. PVC pipe of about 4 inches inside diameter is preferred because a 4 inch diameter leather is about the maximum practical size for the preferred cup-shaped leathers. The cylinders are preferably constructed in standard 10 foot lengths, which may be shortened depending upon the stroke of the pump jack being employed at a particular well. Pumps of various capacities may be constructed using multiple cylinders of varying strokes. A 4 inch diameter by 10 foot standardized cylinder permits more efficient manufacture, stockage and use of parts for the casing gas pump.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

10 casing
12 wellhead
14 tube
16 annulus
18 sucker rod pump
20 sucker rod
22 polished rod
24 sampson post
26 walking beam
28 beam pivot
30 horsehead
32 pitman end
34 pitman
36 crank
38 gear box
40 bridle assembly
42 polished rod clamp
44 carrier bar
46 bridle cables
48 cable anchor
50 cylinders
51 cylindrical bores
52 header
53 header connectors
54 push rods
55 rod guides
56 leather assemblies
57 upper rod clamps
58 upper chambers
59 lower rod clamps
60 lower chambers
61 U-bolts
62 bridle bracket
63 cable guides
64 inlet check valve
66 inlet conduit
67 shutoff valve
68 outlet check valve
70 gas line
72 outlet conduit
74 pressure relief valve
76 bleed valve
78 working leather
80 working leather
82 lubricating leather
84 jam nut
86 plastic spacer
88 jam nut

I claim as my invention:

1. On a well having a. a casing extended downward from ground surface, b. a wellhead associated with the casing above ground surface, c. tubing depended from the well head within the casing and forming d. an annulus between the casing and the tubing, e. a sucker rod including f. a polish rod at a top end thereof extended through the wellhead, g. a sucker rod pump at the bottom of the well connected to the sucker rod, h. a pump jack having (i) a sampson post, (ii) a walking beam pivoted for movement to the sampson post, (iii) a horse head at an end of the walking beam above the wellhead, (iv) a pitman on the walking beam, (v) a bridle assembly connecting the horsehead and the polish rod, (vi) reciprocation means connected to the pitman for moving the horsehead up and down, j. said bridle assembly including (i) a carrier bar, (ii) a polish rod clamp on the polish rod above the carrier bar, (iii) bridle cables connecting the horsehead and the carrier bar;

the improved casing gas pump comprising in combination with the above:

k. a header with an inlet end and an outlet end, l. an inlet check valve fluidly connected to the inlet end of the header,
m. an inlet conduit fluidly connecting the inlet check valve and the annulus,
n. the inlet check valve preventing gas flow from the header into the annulus and allowing gas flow from the annulus into the header,
o. an outlet check valve fluidly connected to the outlet end of the header,
p. an outlet conduit fluidly connected to the outlet check valve,
q. the outlet check valve preventing gas flow from the outlet conduit to the header and allowing gas flow from the header to the outlet conduit,
r. at least one vertical cylinder adjacent to the wellhead having
(i) a top,
(ii) a bottom,
(iii) a cylindrical bore extending from the top to the bottom,
(iv) the cylinder bottom being rigidly and fluidly connected to the header,
s. an upright push rod slidably depended through the cylinder top into the cylindrical bore,
t. a rigid bridle bracket attached to and extending from the bridle cables to a point above the cylinder,
u. the bridle bracket being connected to a top of the push rod so that the push rod has an upstroke and a downstroke responsive and equal to reciprocation of the horsehead and bridle cables, and
v. a piston attached to a bottom of the push rod within the cylinder bore,
w. said piston being in the form of a leather assembly,
x. the leather assembly including at least one downward cup-shaped working pump leather,
y. the leather assembly extending from the push rod to the bore and substantially segregating the volume enclosed by the bore into an upper chamber and a lower chamber,
z. the lower chamber being fluidly connected to the header through the cylinder bottom,
aa. the working pump leather having an edge that is inclined downward and contacting the cylinder bore,
bb. the working pump leather partially collapsing to flow air into the lower chamber during the upstroke when the annulus pressure is less than atmospheric.

2. On a well having
a. a casing extended downward from ground surface,
b. a wellhead associated with the casing above ground surface,
c. tubing depended from the well head within the casing and forming
d. an annulus between the casing and the tubing,
e. a sucker rod including
f. a polish rod at a top end thereof extended through the wellhead,
g. a sucker rod pump at the bottom of the well connected to the sucker rod,
h. a pump jack having
(i) a sampson post,
(ii) a walking beam pivoted for movement to the sampson post,
(iii) a horsehead at an end of the walking beam above the wellhead,
(iv) a pitman on the walking beam,
(v) a bridle assembly connecting the horsehead and the polish rod,
(vi) reciprocation means connected to the pitman for moving the horsehead up and down,
j. said bridle assembly including
(i) a carrier bar,
(ii) a polish rod clamp on the polish rod above the carrier bar,
(iii) bridle cables connecting the horsehead and the carrier bar;

the improved casing gas pump comprising in combination with the above:
k. a header with an inlet end and an outlet end,
l. an inlet check valve fluidly connected to the inlet end of the header,
m. an inlet conduit fluidly connecting the inlet check valve and the annulus,
n. the inlet check valve preventing gas flow from the header into the annulus and allowing gas flow from the annulus into the header,
o. an outlet check valve fluidly connected to the outlet end of the header,
p. an outlet conduit fluidly connected to the outlet check valve,
q. the outlet check valve preventing gas flow from the outlet conduit to the header and allowing gas flow from the header to the outlet conduit,
r. at least one vertical cylinder adjacent to the wellhead having
(i) a top,
(ii) a bottom,
(iii) a cylindrical bore extending from the top to the bottom,
(iv) the cylinder bottom being rigidly and fluidly connected to the header,
s. an upright push rod slidably depended through the cylinder top into the cylindrical bore,
t. a rigid bridle bracket attached to and extending from the bridle cables to a point above the cylinder,
u. the bridle bracket being connected to a top of the push rod so that the push rod has an upstroke and a downstroke responsive and equal to reciprocation of the horsehead and bridle cables, and
v. a piston attached to a bottom of the push rod within the cylinder bore,
w. the volume of the header being substantially smaller than the volume of the cylinder bore,
x. the stroke of the push rod and piston extending substantially the vertical length of the cylinder bore,
y. the piston being in the form of a leather assembly,
z. the leather assembly including two spaces apart downward cup-shaped working pump leathers,
aa. the leather assembly extending from the push rod to the bore and substantially segregating the volume enclosed by the bore into an upper chamber and a lower chamber,
bb. the lower chamber being fluidly connected to the header through the cylinder bottom,
cc. the working pump leathers having edges that are inclined downward and contacting the bore,
dd. the edges of the working pump leathers partially collapsing to flow air into the lower chamber during the upstroke when the annulus pressure is less than atmospheric,
ee. a pressure relief valve fluidly connected to the header between the check valves,
ff. a bleed valve fluidly connected to the header, and
gg. a shutoff valve in the inlet conduit between the inlet check valve and an annulus.

* * * * *